US009891565B1

(12) United States Patent
Miyahara et al.

(10) Patent No.: US 9,891,565 B1
(45) Date of Patent: Feb. 13, 2018

(54) FIXING MEMBER, FIXING APPARATUS AND ELECTROPHOTOGRAPHIC IMAGE FORMING APPARATUS

(71) Applicant: CANON KABUSHIKI KAISHA, Tokyo (JP)

(72) Inventors: Yasuhiro Miyahara, Tokyo (JP); Katsuhisa Matsunaka, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/626,602

(22) Filed: Jun. 19, 2017

(30) Foreign Application Priority Data

Jul. 28, 2016 (JP) ..... 2016-148635

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
CPC ..... G03G 15/2057; G03G 15/206; G03G 2215/2048; G03G 2215/2016
USPC ..... 399/333
See application file for complete search history.

(56) References Cited

U.S. PATENT DOCUMENTS 6,564,033 B2 5/2003 Zhou et al.
7,212,776 B2 5/2007 Takagi et al.
7,376,379 B2 5/2008 Takahashi et al.
7,725,068 B2 5/2010 Matsunaka et al.
7,734,241 B2 6/2010 Nishida et al.
7,991,341 B2 8/2011 Matsunaka et al.
8,005,413 B2 8/2011 Sakakibara et al.
8,224,223 B2 7/2012 Sakakibara et al.
8,369,763 B2 2/2013 Sakakibara et al.
8,401,450 B2 3/2013 Sekihara et al.
8,626,046 B2 1/2014 Sekihara et al.
9,063,491 B2 6/2015 Matsunaka et al.
9,110,411 B2 8/2015 Akiyama et al.
(Continued)

FOREIGN PATENT DOCUMENTS

JP 2001-62380 A 3/2001
JP 2002-213432 A 7/2002
(Continued)

*Primary Examiner* — Sophia S Chen
(74) *Attorney, Agent, or Firm* — Fitzpatrick, Cella, Harper & Scinto

(57) ABSTRACT

The present invention is directed to providing a fixing member that can form high quality electrophotographic images. The fixing member includes a substrate, an elastic layer on the substrate and a surface layer bonded to the elastic layer with an adhesive layer. The surface layer contains a fluorine resin. The surface layer having a thermal resistance in the thickness direction of $3.0\times10^{-5}$ $m^2\cdot K/W$ or more and $1.3\times10^{-4}$ $m^2\cdot K/W$ or less and the peel adhesion strength between the surface layer and the elastic layer is 3.0 N/cm or more and 20.0 N/cm or less, while the elastic layer undergoes a cohesive failure in a peel test between the surface layer and the elastic layer and the fluorine resin contains a tetrafluoroethylene/perfluoroethyl vinyl ether copolymer, the polymerization ratio of perfluoroethyl vinyl ether in the copolymer being 3.0 mol % or more and 5.8 mol % or less.

10 Claims, 3 Drawing Sheets

(56) References Cited

U.S. PATENT DOCUMENTS

| | | | | |
|---|---|---|---|---|
| 9,134,663 | B2 | 9/2015 | Matsunaka et al. | |
| 9,164,450 | B2 | 10/2015 | Matsumoto et al. | |
| 9,268,273 | B2 | 2/2016 | Miyahara et al. | |
| 9,315,703 | B2 | 4/2016 | Matsunaka et al. | |
| 9,335,690 | B2 | 5/2016 | Asaka et al. | |
| 9,348,281 | B2 | 5/2016 | Abe et al. | |
| 9,367,009 | B2 | 6/2016 | Akiyama et al. | |
| 9,665,049 | B2 | 5/2017 | Oshima et al. | |
| 9,671,731 | B2 | 6/2017 | Matsunaka et al. | |
| 2011/0045310 | A1* | 2/2011 | Kishino | C08G 73/1042 428/474.4 |
| 2015/0212461 | A1* | 7/2015 | Abe | B32B 7/12 399/333 |
| 2015/0309451 | A1 | 10/2015 | Akiyama et al. | |
| 2015/0355581 | A1* | 12/2015 | Matsunaka | B05D 3/0272 399/333 |
| 2016/0091841 | A1* | 3/2016 | Matsumoto | B32B 37/06 399/333 |
| 2016/0195838 | A1* | 7/2016 | Matsunaka | G03G 15/2057 399/333 |
| 2016/0252854 | A1 | 9/2016 | Oshima et al. | |
| 2017/0038707 | A1 | 2/2017 | Matsunaka et al. | |

FOREIGN PATENT DOCUMENTS

| | | | |
|---|---|---|---|
| JP | 2002-258648 | A | 9/2002 |
| JP | 2004-161921 | A | 6/2004 |
| JP | 2005-10607 | A | 1/2005 |
| JP | 2005-121825 | A | 5/2005 |
| JP | 2005-300915 | A | 10/2005 |
| JP | 2007-233111 | A | 9/2007 |
| JP | 2008-224835 | A | 9/2008 |
| JP | 2009-244887 | A | 10/2009 |
| JP | 2010-134094 | A | 6/2010 |
| JP | 2016-12128 | A | 1/2016 |
| JP | 2016-95475 | A | 5/2016 |
| WO | 2005/054960 | A1 | 6/2005 |

* cited by examiner

FIXING MEMBER, FIXING APPARATUS AND ELECTROPHOTOGRAPHIC IMAGE FORMING APPARATUS

BACKGROUND OF THE INVENTION

Field of the Invention

The present invention relates to a fixing member to be used for electrophotographs. The present invention also relates to a fixing apparatus and an electrophotographic image forming apparatus employing such a fixing member.

Description of the Related Art

Generally, in heating fixing apparatus to be used for electrophotographic systems such as copying machines and laser printers, a pair of heated rotating members, which may typically be a pair of rollers, a film and a roller, a belt and a roller or a pair of belts, is brought into contact with each other under pressure. Then, a recording medium carrying thereon an image formed by unfixed toner (to be also referred to as "unfixed toner image" hereinafter) is introduced into the pressurized contact site between the rotating members (to be also referred to as "fixing nip part" hereinafter) and the unfixed toner is heated to become molten so as to fix the toner image on the recording medium.

The rotating member that is brought into contact with the unfixed toner image carried on the recording medium is referred to as a fixing member, which may also be referred to as a fixing roller, a fixing film or a fixing belt according to the shape of the fixing member.

Japanese Patent Application Laid-Open No. 2016-12128 discloses a fixing member having a metal-made or heat resistant resin-made substrate, an elastic layer containing silicone rubber and a releasing layer bonded onto the elastic layer via an adhesive agent, the elastic layer and the releasing layer being laminated on the substrate.

Japanese Patent Application Laid-Open No. 2016-95475 discloses a fixing member having a substrate, an elastic layer, and a releasing layer on the elastic layer, which are laminated in this order. The releasing layer according to Japanese Patent Application Laid-Open No. 2016-95475 contains a tetrafluoroethylene/perfluoroalkyl vinyl ether copolymer (PFA). The ratio of perfluoroalkyl vinyl ether (PAVE) based on all the PFA of the releasing layer is 3.0 mol % or more and 5.8 mol % or less. Japanese Patent Application Laid-Open No. 2016-95475 also describes that PFA whose ratio of perfluoroalkyl vinyl ether (PAVE) is 3.0 mol % or more and 5.8 mol % or less has a low crystallinity and is held in a soft rubber-like state at the thermal fixation temperature, which may typically be 150° C.

As described in Japanese Patent Application Laid-Open No. 2016-95475, PFA whose ratio of perfluoroalkyl vinyl ether is 3.0 mol % or more and 5.8 mol % or less (to be also referred to as "soft PFA" hereinafter) has a high flexibility. Therefore, a fixing member having a releasing layer formed by using such a PFA is advantageous in that the surface thereof can satisfactorily follow the surface unevenness of paper. Meanwhile, a conceivable technique of obtaining a fixing member having a releasing layer containing a soft PFA is a technique of bonding a fluorine resin tube, which is a cylindrical extrusion-molded product of soft PFA, to the surface of an elastic layer through the use of a silicone rubber adhesive agent. A fluorine resin tube, which is a cylindrical extrusion-molded product of soft PFA as described above, has characteristics in which its heat conductivity in the thickness direction is lower than its heat conductivity in the direction parallel to the direction of extrusion. This is presumably because the polymer chains of PFA are oriented in the direction parallel to the direction of extrusion as a result of extrusion molding.

The low heat conductivity in the thickness direction of the releasing layer of a fixing member of the type under consideration needs to be improved from the viewpoint of efficiently conducting the heat coming from the heating device arranged on the rear surface side of the fixing member to the side of the releasing layer that is brought into contact with an unfixed toner image that is to be fixed. As a result of intensive research efforts made by the inventors of the present invention, the inventors found that the orientation of the polymer chains in a fluorine resin rube, which is a cylindrical extrusion-molded product of soft PFA, can be relaxed by subjecting the tube to an annealing process to thereby improve the heat conductivity in the thickness direction. However, as a result of annealing a soft PFA-made tube that is bonded to the surface of an elastic layer that contains silicone rubber through the use of a silicone rubber adhesive agent, the inventors confronted an additional problem that the adhesive agent became degraded to consequently reduce the adhesion strength.

SUMMARY OF THE INVENTION

One aspect of the present invention is directed to providing a fixing member that enables formation of high quality electrophotographic images and a method of manufacturing the same.

Another aspect of the present invention is directed to providing a fixing apparatus and an electrophotographic image forming apparatus that contribute to forming high quality electrophotographic images.

According to one aspect of the present invention, there is provided a fixing member having a substrate, an elastic layer on the substrate, and a surface layer bonded to the elastic layer with an adhesive layer, the surface layer containing a fluorine resin; the surface layer having a thermal resistance in the thickness direction of $3.0\times10^{-5}$ $m^2\cdot K/W$ or more and $1.3\times10^{-4}$ $m^2\cdot K/W$ or less; the peel adhesion strength between the surface layer and the elastic layer being 3.0 N/cm or more and 20.0 N/cm or less; the elastic layer undergoing a cohesive failure in a peel test between the surface layer and the elastic layer; the fluorine resin containing a tetrafluoroethylene/perfluoroethyl vinyl ether copolymer; the polymerization ratio of perfluoroethyl vinyl ether in the tetrafluoroethylene/perfluoroethyl vinyl ether copolymer being 3.0 mol % or more and 5.8 mol % or less.

According to another aspect of the present invention, there is provided a fixing apparatus having a fixing member as defined above and a heating device of the fixing member.

According to still another aspect of the present invention, there is provided an electrophotographic image forming apparatus having a fixing apparatus as defined above.

According to further aspect of the present invention, there is provided a method of manufacturing a fixing member having:

(1) providing a fluorine resin tube containing a fluorine resin, the fluorine resin tube being a cylindrical extrusion-molded product of fluorine resin;

(2) bonding the fluorine resin tube to the surface of an elastic layer on a substrate with an addition curable type silicone rubber adhesive layer; and (3) heating the fluorine resin tube bonded onto the elastic layer to above the melting point of the fluorine resin contained in the fluorine resin tube;

the fluorine resin containing a tetrafluoroethylene/perfluoroethyl vinyl ether copolymer;

the polymerization ratio of perfluoroethyl vinyl ether in the tetrafluoroethylene/perfluoroethyl vinyl ether copolymer being 3.0 mol % or more and 5.8 mol % or less;

the addition curable type silicone rubber adhesive layer containing titanium oxide.

Further features of the present invention will become apparent from the following description of exemplary embodiments with reference to the attached drawings.

DESCRIPTION OF THE EMBODIMENTS

Now, a fixing member, a method of manufacturing the same, a heating fixing apparatus and an image forming apparatus according to one aspect of the present invention will be described below in detail with reference to the specific configuration. Note, however, that the scope of the present invention is by no means limited by the embodiments that will be described hereinafter. In other words, all the modifications and alternations that can be made to those embodiments are also within the scope of the present invention.

A fixing member according to one aspect of the present invention shows an excellent followability to surface unevenness of paper tissues and therefore can suppress any melt unevenness of toner in the fixing nip part. Additionally, the fixing member shows an improved heat conductivity in the thickness direction of a fluorine resin surface layer thereof and therefore also shows an improved fixability. This advantage leads to reduction of TEC (typical electricity consumption) of an electrophotographic image forming apparatus. In addition to the above identified advantages, an advantage of excellent adhesion between the fluorine resin surface layer and a silicone rubber elastic layer is also provided.

(1) Schematic Configuration of Fixing Belt

Figure 1:
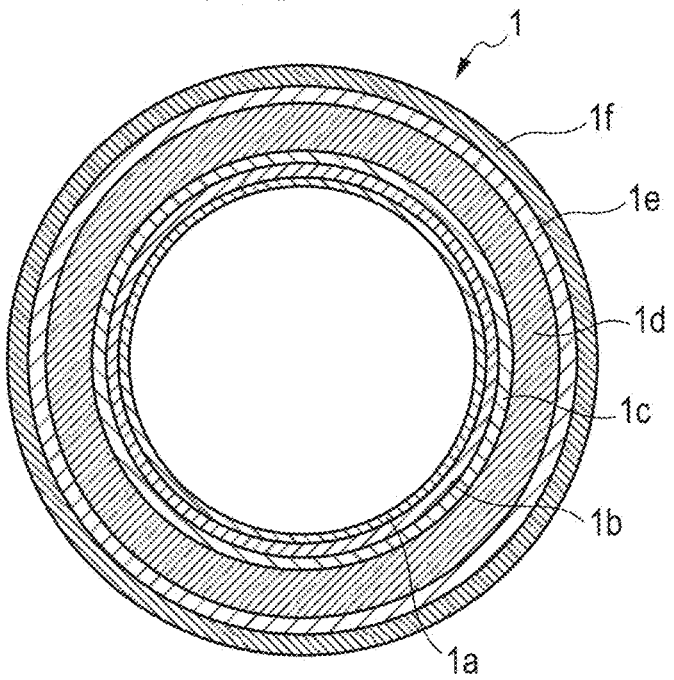
FIG. 1 is a schematic cross-sectional view of an embodiment of fixing member according to the present invention.

FIG. 1 is a schematic cross-sectional view of an embodiment of a fixing member according to one aspect of the present invention in the form of an endless belt (to be also referred to as "fixing belt" hereinafter). In the fixing belt 1, an inner surface sliding layer 1*a* is arranged on the inner circumferential surface of a substrate 1*b* in the form of an endless belt. The inner surface sliding layer is provided in order to improve the sliding performance between the fixing belt and a pressure member. The inner surface sliding layer 1*a* may be omitted if the sliding performance does not need to be particularly improved.

An elastic layer is arranged on the outer circumferential surface of the substrate. More specifically, the outside circumferential surface of the substrate 1*b* is covered by a silicone rubber elastic layer 1*d* arranged thereon via a primer layer 1*c*. A fluorine resin surface layer 1*f* is arranged on the silicone rubber elastic layer 1*d* via a silicone rubber adhesive layer 1*e*. Each of the above-mentioned components will more specifically be described below.

(2) Substrate

Since heat resistance is required in the fixing belt 1, the substrate 1*b* is preferably selected by taking the heat resistance and the bending resistance thereof into consideration. As for a metal-made substrate, any of electroformed nickel substrates disclosed in Japanese Patent Application Laid-Open No. 2002-258648, International Publication No. WO2005/054960 and Japanese Patent Application Laid-Open No. 2005-121825 can be used. As for a resin-made substrate, any of highly heat-resistant resin-made substrates including polyimide resin, polyamide-imide resin or polyether ether ketone resin as disclosed in Japanese Patent Application Laid-Open No. 2005-300915 and Japanese Patent Application Laid-Open No. 2010-134094 can be used. While the thickness of the substrate of the fixing belt is not subjected to any particular limitations, the thickness of the substrate is preferably 20 μm or more and 100 μm or less, more preferably 20 μm or more and 60 μm or less from the viewpoint of flexibility and durability. Like the fixing belt 1, the substrate 1*b* is preferably in the form of an endless belt. In the embodiment shown in FIG. 1, the substrate is a cylindrical substrate.

(3) Sliding Layer and Method of Forming the Same

A highly durable and heat-resistant resin material such as polyimide resin, polyamide-imide resin or polyether ether ketone resin can suitably be used for the sliding layer 1*a*. Particularly, the use of polyimide resin is preferable from the viewpoint of easiness of preparation, heat-resistance, modulus of elasticity, strength and so on. A polyimide resin layer can be formed in a manner as described below. Namely, a polyimide resin layer can be formed by applying polyimide precursor solution, which is obtained by causing aromatic tetracarboxylic dianhydride or a derivative thereof and aromatic diamine to react in organic polar solvent by approximately equal moles, to the inner circumferential surface of the cylindrical substrate and drying and heating the solution so as to cause a dehydration and ring closure reaction to take place in the solution.

Ring coating or some other appropriate technique can suitably be used for the application of the solution. After applying the polyimide precursor solution to the inner circumferential surface of the cylindrical substrate 1*b*, the cylindrical substrate, which now carries the applied solution on the inner circumferential surface thereof, is left in a hot air circulating oven, which is typically heated to 60° C., for 30 minutes to dry the solution. Subsequently, the substrate is left again in the hot air circulating oven, which is now heated to somewhere between 200 and 240° C., for 10 to 60 minutes and baked to cause a dehydration and ring closure reaction to take place there to form a polyimide inner surface sliding layer.

(4) Silicone Rubber Elastic Layer and Method of Forming the Same

The silicone rubber elastic layer 1*d* functions as an elastic layer to be carried by the fixing member in order to uniformly apply pressure to a toner image and the uneven surface of a sheet of paper in fixing operation. From the viewpoint of exerting such the function, the material of the silicone rubber elastic layer 1*d* is not subjected to any particular limitations. From the viewpoint of workability, the silicone rubber elastic layer 1*d* is preferably formed by using addition curable type silicone rubber.

Generally, addition curable type silicone rubber contains organopolysiloxane having one or more unsaturated aliphatic groups, organopolysiloxane having active hydrogen coupled to silicon and a platinum compound as a cross-linking catalyst.

Organopolysiloxane having active hydrogen coupled to silicon forms a cross-linked structure as a result of a reaction with the alkenyl group of organopolysiloxane component having one or more unsaturated aliphatic groups under the catalytic effect of the platinum compound.

The silicone rubber elastic layer 1*d* may contain a filler material for the purpose of improving the heat conductivity of the fixing member and also for the purpose of reinforcing and improving the heat-resistance of the fixing member.

For the purpose of improving the heat conductivity of the fixing member, in particular, the use of a filler material that shows a high heat conductivity is preferable. Specific examples of filler materials include inorganic substances, particularly, metals and metal compounds.

Specific examples of high heat conductivity filler materials include silicon carbide (SiC), silicon nitride ($Si_3N_4$), boron nitride (BN), aluminum nitride (AlN), alumina ($Al_2O_3$), zinc oxide (ZnO), magnesium oxide (MgO), silica ($SiO_2$), copper (Cu), aluminum (Al), silver (Ag), iron (Fe) and nickel (Ni). Any of the above listed materials may be used alone or two or more of them may be mixed for use.

From the viewpoint of ease of handling and dispersibility, the average particle size of the high heat conductivity filler is preferably 1 μm or more and 50 μm or less. The expression of average particle size as used herein refers to the particle size of 50% relative amount of particles (volume-based) as determined by a laser diffraction/scattering method. The particle shape may be spherical, granular, plate-like and/or whisker-like, although the use of spherical particles is preferable from the viewpoint of dispersibility.

In view of the role of the silicone rubber elastic layer of serving to the surface hardness of the fixing member and the efficiency of heat conduction to unfixed toner in fixing operations, the range of the thickness of the silicone rubber elastic layer is preferably 100 μm or more and 500 μm or less, more preferably 200 μm or more and 400 μm or less.

With regard to processing methods that can be used for forming a silicone rubber elastic layer, molding methods of using a metal mold, blade coating methods, nozzle coating methods and the ring coating methods are widely known as disclosed in Japanese Patent Application Laid-Open No. 2001-62380 and Japanese Patent Application Laid-Open No. 2002-213432. By using any of the above-described methods, a silicone rubber elastic layer can be formed by heating and cross-linking the source mixture carried on the substrate.

To improve the adhesion between the cylindrical substrate 1*b* and the silicone rubber elastic layer 1*d*, the cylindrical substrate 1*b* is preferably treated with a primer in advance. The primer to be used for this purpose is required to wet the cylindrical substrate 1*b* well if compared with the silicone rubber elastic layer 1*d*. Examples of primers that satisfy the above requirement include hydrosilyl-based (SiH-based) silicone primers, vinyl-based silicone primers and alkoxy-based silicone primers. The thickness of the primer layer 1*c* is desirably 0.5 μm or more and 3 μm or less from the viewpoint of the amount of the primer that exerts the adhesion performance, while reducing the unevenness of the primer layer.

(5) Surface Layer, Method of Forming the Same

The surface layer 1*f* that contains fluorine resin is a layer that takes an important role of securing the uniformity of the produced image along with the silicone rubber elastic layer.

The fluorine resin that the surface layer contains in turn contains tetrafluoroethylene/perfluoroethyl vinyl ether copolymer, which is a kind of tetrafluoroethylene/perfluoroalkyl vinyl ether copolymer (PFA). The surface layer can be formed by using tetrafluoroethylene/perfluoroethyl vinyl ether copolymer.

That the polymerization ratio of perfluoroethyl vinyl ether in the tetrafluoroethylene/perfluoroethyl vinyl ether copolymer is 3.0 mol % or more and 5.8 mol % or less is vitally important.

The PAVE skeleton section of tetrafluoroethylene/perfluoroalkyl vinyl ether copolymer (PFA) inhibits the crystallization to be brought forth by the skeleton section of the copolymer in tetrafluoroethylene (to be also referred to as TFE hereinafter). In other words, the PAVE skeleton section mainly exists in the amorphous regions of PFA. A large number of amorphous regions can be formed by making the polymerization ratio of PAVE to be 3.0 mol % or more and 5.8 mol % or less. When PAVE goes below 3.0 mol %, the PTFE (polytetrafluoroethylene) skeleton forms a large number of crystal regions to consequently reduce the flexibility of the fixing member. Then, as a result, the followability of the fixing member to paper falls. When PAVE exceeds 5.8 mol %, on the other hand, the modulus of elasticity of PFA falls to reduce the abrasion resistance.

The glass transition temperature of PFA is generally somewhere around 100° C., although it varies depending on the composition thereof. The actual operation temperature zone of the fixing member is around 150° C., which are higher than the glass transition temperature, and hence PFA exists in a so-called rubber state at those temperatures. Since PFA to be used for the present invention has many amorphous regions and the number thereof is larger than the number of amorphous regions of ordinary PFA, the former can be more flexible at and near the fixing temperature. As a result of exhibiting the synergistic effect of the above-described composition of the releasing layer (fluorine resin surface layer) and the composition of the silicone rubber elastic layer, melt unevenness of toner can be reduced.

Popularly known PAVE includes perfluoromethyl vinyl ether (PMVE), perfluoroethyl vinyl ether (PEVE) and perfluoropropyl vinyl ether (PPVE). However, in the present invention, the use of PEVE is vitally important. The is because PEVE is superior to PMVE and PPVE from the viewpoint of capability of raising the flexibility of the fixing member in the operation temperature zone without reducing the rigidity thereof in the room temperature zone, from the viewpoint of ease of synthesis and also from the viewpoint of avoidance of fissures due to stress cracks.

Any of known techniques can be used for synthesis of PFA. For example, PFA can be synthesized by a method disclosed in Japanese Patent Application Laid-Open No. 2004-161921.

With an exemplar method of forming a fluorine resin surface layer 1*f*, the surface of the silicone rubber elastic layer is covered by a tubular molded product of fluorine resin, in particular a fluorine resin tube molded to show a tubular profile by extrusion molding, by way of adhesive.

More specifically, a fluorine resin surface layer can be formed in a manner as described below. Firstly, addition curable type silicone rubber adhesive is applied to the surface of the above-described silicone rubber elastic layer 1*d*. Then, the outer surface thereof is covered by a fluorine resin tube, which is a cylindrical extrusion-molded product of fluorine resin, to produce a laminated body. While the method to be used for the covering operation is not subjected to any particular limitations, a technique of using an addition curable type silicone rubber adhesive agent as lubricant for the covering operation or a technique of covering from outside with expanding a fluorine resin tube preferably be employed.

The thickness of the surface layer is desirably within a range between 6 and 23 μm. A fluorine resin tube itself can be formed with ease when the surface layer has a thickness of 6 μm or more, while excellent heat conductivity can be obtained when the surface layer has a thickness of 23 μm or less.

The excessive addition curable type silicone rubber adhesive agent that is left between the cured silicone rubber elastic layer 1*d* and the fluorine resin surface layer 1*f* is squeezed out to remove by using an appropriate means. The thickness of the adhesive layer after the squeezing out operation is preferably 10 μm or less so as not to damage the heat conductivity. The addition curable type silicone rubber adhesive agent may be one in which a self-adhesive component, which may typically be silane having a functional group of acryloxy group, hydrosilyl group (SiH group), epoxy group, alkoxysilyl group or the like, is compounded. The addition curable type silicone rubber adhesive agent is then heated by heating device such as an electric oven or the like for a predetermined period of time to cure so as to be an adhesive layer 1*e*. Such an adhesive layer contains a cured product of an addition curable type silicone rubber adhesive. More particularly, such an adhesive layer may be made of a cured product of an addition curable type silicone rubber adhesive. Thus, a fluorine resin tube can be bonded to the surface of the elastic layer by an addition curable type silicone rubber adhesive layer in a manner as described above.

Prior to the adhesion step, the adhesiveness of the inner surface of the fluorine resin tube can be improved by executing a sodium treatment, an excimer laser treatment, an ammonium treatment or the like on the inner surface in advance. An ultraviolet (UV) treatment may appropriately be executed on the silicone rubber elastic layer in a manner as disclosed in Japanese Patent Application Laid-Open No. 2009-244887. The purpose of such a UV treatment is to maintain the surface hardness of the fixing member to an appropriate level by suppressing any excessive permeation of addition curable type silicone rubber adhesive to the silicone rubber elastic layer and preserving the elasticity of the underlying silicone rubber elastic layer.

Figure 2:
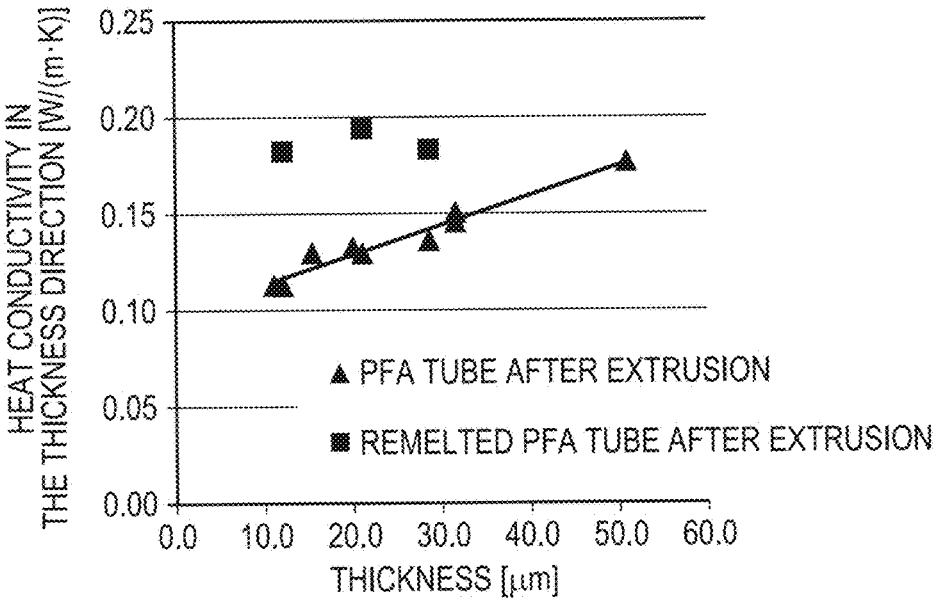
FIG. 2 is a graph illustrating the relationship between the thickness of fluorine resin surface layer and the heat conductivity in the thickness direction thereof.

(6) Fluorine Resin Tube Orientation Relaxing Treatment and Preservation of Adhesion between Fluorine Resin Tube and Silicone Rubber Elastic Layer After the covering operation using a fluorine resin tube, the molecular orientation of the fluorine resin tube is preferably relaxed by heating the fluorine resin to a temperature not lower than the melting point thereof. This is because the fluorine resin tube is molded by extrusion molding and hence the molecular orientation of the fluorine resin tube in the longitudinal direction (MD) thereof at the time of the molding process is intensified as the thickness of the fluorine resin tube is reduced. Then, as a result, the heat conductivity falls in the thickness direction as evidenced by the trend line for the triangle plots (A) in FIG. 2 (a graph illustrating the relationship between the thickness of fluorine resin surface layer and the heat conductivity in the thickness direction thereof). The heat conductivity of the fluorine resin tube in the thickness direction can be raised by heating the fluorine resin tube to a temperature not lower than the melting point thereof and relaxing the molecular orientation produced at the time of molding process as indicated by square plots (□) in FIG. 2.

The melting point of the soft PFA that the fluorine resin tube contains is typically between about 300° C. and 315° C. Therefore, for the purpose of relaxing the orientation of the fluorine resin tube, the temperature of the fluorine resin tube is preferably held to a temperature of, for instance, 320° C. or higher for a predetermined period of time. The predetermined period of time is, roughly speaking, 3 minutes or more and preferably 5 minutes or more. Note that the temperature to which the fluorine resin tube is heated is preferably 350° C. or less for the purpose of suppressing degradation of the fluorine resin.

When the fluorine resin tube is heated on the adhesive layer to a relatively high temperature of not lower than the melting point of fluorine resin in order to relax the orientation of the fluorine resin tube, measures for suppressing degradation of the adhesive layer due to heat is preferably taken. A higher adhesion strength can be maintained between the surface layer and the silicone rubber elastic layer by suppressing degradation of the adhesive layer.

Examples of measures that can be taken to suppress degradation of the adhesive layer due to heat include compounding a radical trapping agent such as titanium oxide with the uncured adhesive agent in advance. Titanium oxide provides an effect of suppressing softening deterioration by suppressing the cracking of the methyl group of the addition curable type silicone rubber contained in the adhesive agent. As for the content ratio of titanium oxide particles in the adhesive agent, the adhesive agent preferably contains 0.1 parts by mass or more and 12.0 parts by mass or less of titanium oxide particles per 100 parts by mass of the uncured silicone rubber in the adhesive agent. As for the particle size of titanium oxide, the smaller the particle size the higher the effect of using titanium oxide. More specifically, the particle size of 50% relative amount of particles (volume-based) as determined by a laser diffraction/scattering method is, preferably, 100 nm or less, more preferably 50 nm or less.

From the viewpoint of improving the heat conductivity of the fixing member, that the thermal resistance of the fluorine resin surface layer in the thickness direction as computationally determined by the formula of "thickness/heat conductivity" is $3.0\times10^{-5}$ $m^2\cdot K/W$ or more and $1.3\times10^{-4}$ $m^2\cdot K/W$ or less is vitally important. This is because the formation of the fluorine resin surface layer becomes difficult when the thermal resistance falls below $3.0\times10^{-5}$ ($m^2\cdot K/W$), whereas the heat conductivity from the fixing member to the recording medium falls when the thermal resistance rises above $1.3\times10^{-4}$ ($m^2\cdot K/W$). When the thickness of the fluorine resin tube is reduced in an attempt to reduce the thermal resistance in the thickness direction, there can be an instance where the thermal conductively falls due to molecular orientation. For this reason, after the covering operation using a thin fluorine resin tube, for instance, the fluorine resin tube is heated to above the melting point thereof to exploit the effect of relaxing the molecular orientation for the purpose of adjusting and confining the thermal resistance in the thickness direction within the above defined range.

After executing the covering operation using the fluorine resin tube and the operation of heating the fluorine resin tube above the melting point thereof to relax the molecular orientation of the fluorine resin tube, a fixing belt 1 having a desired length can be obtained by cutting the opposite ends thereof.

(7) Schematic Configuration of Fixing Apparatus

Figure 3:
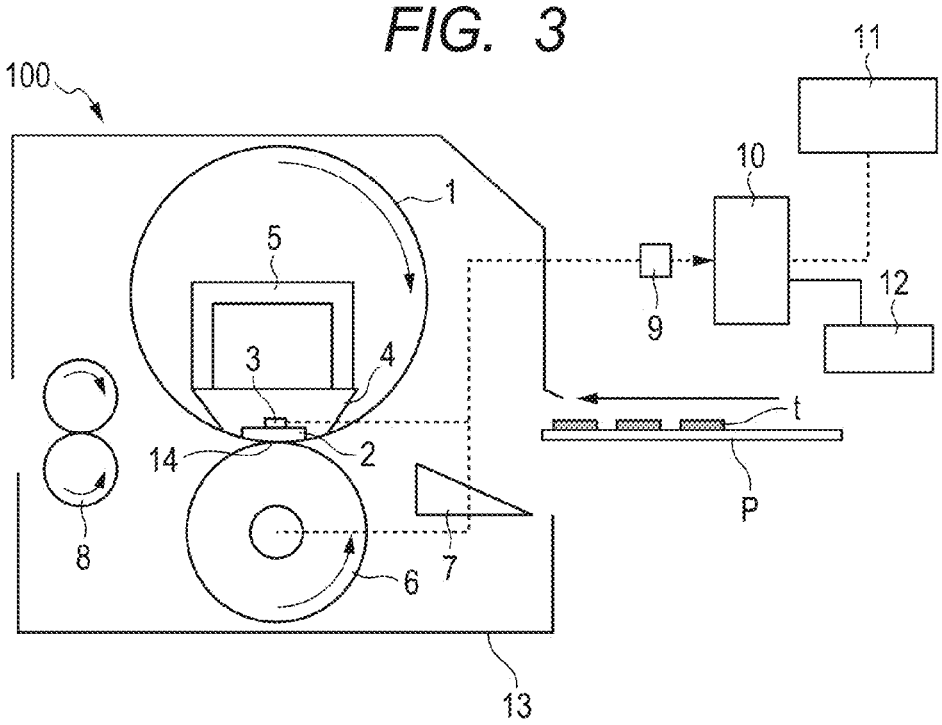
FIG. 3 is a schematic cross-sectional view of an embodiment of fixing apparatus according to the present invention.

FIG. 3 is a schematic cross-sectional view of an embodiment of fixing apparatus according to the present invention. This fixing apparatus has a fixing member as described above and a heating device of the fixing member. Any heating device known in the field of fixing apparatus such as an electric heater can appropriately be used as the heating device of the fixing apparatus. Note that the fixing belt 1 and the fixing heater 2 shown in FIG. 3 are respectively a fixing member and a heating device.

The fixing apparatus 100 of this embodiment includes a fixing belt 1 as described above. A pressure roller 6 is provided as a pressure member for forming a fixing nip part 14 with the fixing belt 1 between itself and the fixing belt 1. Additionally, a fixing heater 2 is provided so as to operate both as a nip part forming member and as a heater, and a heat-resistant film guide/heater holder 4 is provided. The fixing heater 2 is fixed to the lower surface of film guide/heater holder 4 along the longitudinal direction of the film guide/heater holder 4. The heated surface of the fixing belt 1 can move, sliding on the heating surface of the fixing heater 2. The fixing belt 1 is fitted to the outside of the film guide/heater holder 4 with a certain degree of freedom of movement. The film guide/heater holder 4 is formed of highly heat-resistant liquid crystal polymer resin so as to take a role of holding the fixing heater 2 and, at the same time, causing the fixing belt 1 to take a posture good for separating the recording medium P that has been brought into the fixing nip part 14 from the fixing belt 1. The pressure roller 6 is formed by sequentially laminating a silicone rubber layer and a PFA resin tube on a metal-made core so as to be a multilayer structure. The opposite ends of the metal core of the pressure roller 6 are borne by respective bearings so as to be rotatable between a pair of lateral plates (not shown) arranged at the distal end side and the proximal end side of the apparatus frame 13 in FIG. 3. A fixing unit having the fixing heater 2, the film guide/heater holder 4, a fixing belt stay 5 and the fixing belt 1 is arranged at the upper side of the pressure roller 6. The fixing unit is arranged in parallel with the pressure roller 6 with its fixing heater 2 side facing downward. The opposite ends of the fixing belt stay 5 are urged against the pressure roller 6 by a pressure mechanism (not shown) such that predetermined force (e.g., 156.8 N (16 kgf)) is applied to each of the opposite ends (to make the total force equal to 313.6 N (32 kfg)). As a result of this arrangement, the lower surface (heating surface) of the fixing heater 2 is brought into contact with the pressure roller 6 via the fixing belt 1 so as to exert predetermined pressure onto the pressure roller 6 against the resilient force of the silicone rubber elastic layer of the pressure roller 6 and produce there a fixing nip part 14 having a predetermined width that is required for fixing operations. A thermistor 3 (heater temperature sensor) that operates as a temperature detector is arranged on the rear surface (the surface opposite to the heating surface) of the fixing heater 2, which is a heat source, to take the role of sensing the temperature of the fixing heater 2. The pressure roller 6 is driven to rotate in the direction indicated by an arrow in FIG. 3 at a predetermined circumferential speed. Then, as a result, the fixing belt 1 that is brought into contact with the pressure roller 6 under pressure follows the rotary motion of the pressure roller 6 to rotate at a predetermined circumferential speed. Note that the inner surface of the fixing belt 1 is held in tight contact with the lower surface of the fixing heater 2 and slides thereon and rotate on the outer surface of the film guide/heater holder 4 in the direction indicated by an arrow in FIG. 3.

Semisolid lubricant (to be referred to as grease hereinafter) containing a solid component (compound) and a base oil component (oil) is applied to the inner surface of the fixing belt 1 to secure the frictional sliding performance between the film guide/heater holder 4 and the inner surface of the fixing belt 1. Examples of materials that can be used as compound for the semisolid lubricant include solid lubricants such as graphite and molybdenum disulfide, metal oxides such as zinc oxide and silica and fluorine resins such as PFPE (perfluoropolyether) and PTFE. Examples of materials that can be used as base oil for the semisolid lubricant include heat-resistant polymer resin oils such as silicone oil and fluorosilicone oil. Typically, of these, PTFE fine powder particles (particle size 3 μm) and grease prepared by using fluorosilicone oil are respectively employed as compound and oil.

The thermistor 3 is arranged so as to contact the rear surface of the fixing heater 2 and connected to a control circuit section (CPU) 10 that operates as control device via an A/D converter 9. The control circuit section (CPU) 10 is designed to execute sampling for respective outputs from the thermistor 3 at a predetermined cycle so as to reflect the obtained temperature information to the temperature control operation. In other words, the control circuit section (CPU) 10 decides how to control the temperature of the fixing heater 2 according to the output of the thermistor 3. Thus, the control circuit section (CPU) 10 plays a role of controlling the operation of electrically energizing the fixing heater 2 so that the temperature of the fixing heater 2 becomes the target temperature (preset temperature) through the use of a heater drive circuit section 11, which is a power supply section. Additionally, the control circuit section (CPU) 10 also takes a role of controlling the remaining lifetime estimation sequence of the fixing belt, which will be described in detail below. The control circuit section (CPU) 10 is also connected to a drive motor of the pressure roller 6 via the A/D converter 9. The fixing heater 2 has an alumina substrate and a resistance heating element that is arranged on the substrate and prepared by uniformly applying an electro-conductive paste containing a silver/palladium alloy to the substrate to produce an about 10 μm-thick filmy layer on the substrate by screen printing. The fixing heater 2 additionally has a glass coat formed thereon by using pressure-resistant glass. Thus, the fixing heater 2 is formed as a ceramic heater. The drive motor of the pressure roller 6 is driven by a motor drive circuit section 12.

Recording medium P that carries thereon an unfixed toner image t is guided by inlet guide 7 and led to the fixing nip part 14 before it is discharged from the fixing apparatus 100 a fixing/discharge roller 8.

(8) Schematic Configuration of Image Forming Apparatus

Figure 4:
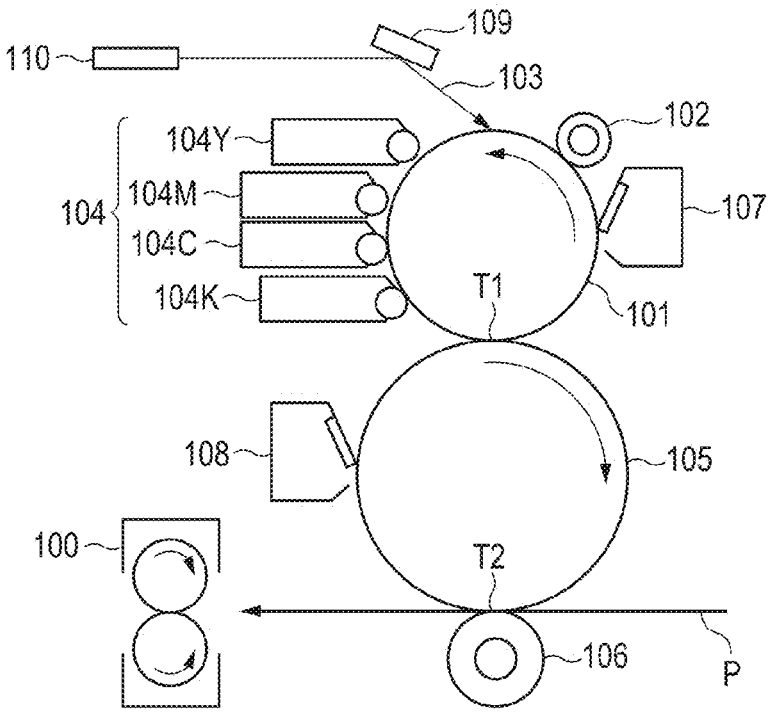
FIG. 4 is a schematic cross-sectional view of an embodiment of electrophotographic image forming apparatus according to the present invention.

FIG. 4 is a schematic cross-sectional view of an embodiment of electrophotographic image forming apparatus according to the present invention. In FIG. 4, 101 denotes a photosensitive drum that operates as image bearing member. The photosensitive drum 101 is driven to rotate counterclockwise as indicated by an arrow in FIG. 4 at a predetermined processing velocity (circumferential speed). On the way of its rotary motion, the photosensitive drum 101 is electrically charged to a predetermined polarity by a charging device 102, which may typically be a charging roller. Then, the electrically charged surface of the photosensitive drum 101 is exposed to light, which is in the form of a laser beam 103 output from a laser optical system 110, according to the image information input to the apparatus. The laser optical system 110 outputs a laser beam 103 that is modulated (turned on/off) according to a time-series electric digital pixel signal representing the information on a target image and coming from an image signal generator (not shown), which may typically be an image reader, so as to scan the surface of the photosensitive drum 101 and expose the surface to the laser beam. Then, as a result of the scanning/exposure operation, an electrostatic latent image that corresponds to the image information is formed on the surface of the photosensitive drum 101. A deflector mirror 109 is driven to operate for the purpose of deflecting the laser beam 103 output from the laser optical system 110 to the target exposure position on the photosensitive drum 101. The electrostatic latent image formed on the photosensitive drum 101 is turned into a visible image (developed) by a yellow toner supplied from yellow developer unit 104Y of developing apparatus 104. The yellow toner image is then transferred onto the surface of intermediate transfer drum 105 in a primary transfer operation at primary transfer section T1 located at the contact position of the photosensitive drum 101 and the intermediate transfer drum 105. The residual toner remaining on the surface of the photosensitive drum 101 is cleaned by a toner cleaner 107. A process cycle of electric charging-exposure-development-primary transfer—cleaning as described above is repeated to form a magenta toner image (by an operation of developer unit 104M), a cyan toner image (by an operation of developer unit 104C) and a black toner image (by an operation of developer unit 104K). The toner images of the four colors sequentially formed on the intermediate transfer drum 105 one on the other in the above-described manner are then collectively subjected to a secondary transfer operation executed at secondary transfer section T2 located at the contact position of the intermediate transfer drum 105 and transfer roller 106 and transferred onto recording medium P. The residual toners of the different colors remaining on the intermediate transfer drum 105 are removed by a toner cleaner 108. The cleaner 108 is arranged so as to be brought into contact with and moved away from the intermediate transfer drum 105. In other words, the cleaner 108 is brought into contact with the intermediate transfer drum 105 only when the intermediate transfer drum 105 is to be cleaned. Note that the transfer roller 106 is also arranged so as to be brought into contact with and moved away from the intermediate transfer drum 105. In other words, the transfer roller 106 is brought into contact with the intermediate transfer drum 105 only when a secondary transfer operation is to be executed. After passing through the secondary transfer section T2, the recording medium P is introduced into the fixing apparatus 100, which is an image heating apparatus, and the unfixed toner image carried on the recording medium P is subjected to a fixing process (image heating process). The recording medium P that has been subjected to a fixing process is then discharged to the outside of the apparatus to complete the sequential image forming operations.

According to one aspect of the present invention, there is provided a fixing member that shows excellent followability to surface unevenness of paper tissues, improved heat conductivity in the thickness direction of the fluorine resin surface layer thereof and excellent adhesiveness between the fluorine resin surface layer and the silicone rubber elastic layer thereof. In another aspect of the present invention, there are provided a fixing apparatus and an electrophotographic image forming apparatus that contribute to form high quality electrophotographic images.

EXAMPLES

Example 1

A fixing member, a fixing belt to be more specific, having a configuration as shown in FIG. 1 was prepared in Example 1. As substrate, an endless cylindrical substrate made of a nickel-iron alloy as disclosed in International Publication No. WO2005/054960 and having an inner diameter (diameter) of 30 mm, a thickness of 40 μm and a length of 400 mm was selected and used.

A five-fold dilution (mass-based) of a polyimide precursor, which was made of 3,3'4,4'-biphenyltetracarboxylic acid dianhydride and paraphenylene diamine, diluted with N-methyl-2-pyrolydone was provided as a polyimide precursor solution. The precursor solution was applied to the inner surface of the cylindrical substrate by ring-coating and baked at 200° C. for 20 minutes to imidize the polyimide precursor and form a 15 μm-thick inner surface sliding layer.

A hydrosilyl-based silicone primer (DY39-051 A/B: tradename, available from Shin-Etsu Chemical Co., Ltd.) was applied to the front surface of the cylindrical substrate and baked at 200° C. for 5 minutes to obtain a primer layer having a film thickness of 1 μm.

An addition curable type silicone rubber was applied to the outside of the primer layer to a thickness of 300 μm and baked at 200° C. for 30 minutes. For this purpose, materials (a) and (b) shown below were compounded so as to make the ratio of the number of vinyl groups (H/Vi) relative to the number of Si—H groups equal to 0.45 and a platinum compound was added thereto by a catalytic amount to obtain the source liquid of addition curable type silicone rubber.

(a) vinylated polydimethyl siloxane having two or more vinyl groups per molecule (weight average molecular weight 100,000 (in terms of polystyrene)); and (b) hydrogenorganopolysiloxane having two or more Si—H bonds per molecule (weight average molecular weight 1,500 (in terms of polystyrene)).

An endless belt having layers formed up to a silicone rubber elastic layer was brought in and the elastic layer was irradiated with UV rays by a UV ray lamp arranged at a distance of 10 mm from the surface of the belt, while the endless belt was being driven to rotate in a circumferential direction at a moving speed of 20 mm/sec. The UV ray lamp was a low pressure mercury UV ray lamp (GLQ500US/11: tradename, available from Toshiba Lighting & Technology Corporation) and the elastic layer was irradiated with UV rays at 100° C. for 5 minutes in the atmosphere.

The heated endless belt was cooled to room temperature and additionally an addition curable type silicone rubber adhesive agent (SE1819CV: tradename, available from Dow Corning Toray Co., Ltd., a mixture of equal amounts of "Liquid A" and "Liquid B") was substantially uniformly applied thereto to a thickness of about 10 μm. Titanium oxide was compounded in the adhesive agent so that the problem of softening and degradation due to high temperature heating could be suppressed owing to the radical trapping effect of the titanium oxide.

Then, the fixing belt was covered by a fluorine resin tube all around the belt. The fluorine resin tube was prepared by extrusion molding, using fluorine resin pellet A (Teflon PFA959HPPlus: tradename, available from Du Pont-Mitsui Fluorochemicals Co., Ltd.) as source material. The obtained fluorine resin tube had a length of 400 mm, an inner diameter of 29 mm and a thickness of 20 μm. The fluorine resin pellet A was made of tetrafluoroethylene/perfluoroalkyl vinyl ether copolymer (PFA). More specifically, the fluorine resin pellet A is made of a copolymer containing perfluoroethyl vinyl ether (PEVE) by 4.2 mol % as perfluoroalkyl vinyl ether (PAVE). Note that the polymer ratio of PEVE can be determined by a method that will be described hereinafter.

Thereafter, the excessive adhesive agent was squeezed out from between the silicone rubber elastic layer and the fluorine resin tube so as to make the adhesive layer sufficiently thin by uniformly wiping the belt surface from above by way of the fluorine resin tube. Then, the adhesive agent was cured by heating it in an electric oven whose temperature was set to be equal to 200° C. for 5 minutes to cause the fluorine resin tube to rigidly adhere to the silicone rubber elastic layer. Additionally and subsequently, the orientation of the fluorine resin tube was relaxed and the heat conductivity thereof was improved by heating the tube in an electric oven whose temperature was set to be equal to 320° C. for 5 minutes. Then, the opposite ends of the endless belt were cut to obtain a fixing belt having a width of 343 mm.

The endless belt was then mounted on an electrophotographic image forming apparatus (imageRUNNER-ADVANCE C5051: tradename, available from Canon Inc.) and subjected to a melt unevenness evaluation test and a fixability evaluation test, which will be described in detail hereinafter. Thereafter, the fixing belt was taken out and subjected to a peel evaluation test to evaluate the fixing belt alone. Table 1 shows the obtained results. Note that the image forming apparatus had a configuration as shown in FIG. 4 and the fixing apparatus had a configuration as shown in FIG. 3.

Example 2

A fluorine resin tube having a length of 400 mm, an inner diameter of 29 mm and a thickness of 6 μm was formed by extrusion molding, using fluorine resin pellet A. The fixing belt of this example was prepared as in Example 1 except that this fluorine resin tube was employed. Table 1 also shows the results of evaluations of this fixing belt.

Example 3

A fluorine resin tube having a length of 400 mm, an inner diameter of 29 mm and a thickness of 23 μm was formed by extrusion molding, using fluorine resin pellet A. The fixing belt of this example was prepared as in Example 1 except that this fluorine resin tube was employed. Table 1 also shows the results of evaluations of this fixing belt.

Example 4

Fluorine resin pellet C was prepared by mixing, kneading and extruding fluorine resin pellet A and fluorine resin pellet B (Teflon PFA 950HP-Plus: tradename, available from Du Pont-Mitsui Fluorochemicals Co., Ltd.) at a ratio of 13:87 (mass ratio).

Fluorine resin pellet C was made of a tetrafluoroethylene/perfluoroalkyl vinyl ether copolymer (PFA). As for its composition, $^{19}F$ nuclei were observed by nuclear magnetic resonance equipment to confirm that the copolymer contained perfluoroethyl vinyl ether (PEVE) by 3.0 mol % as perfluoroalkyl vinyl ether (PAVE).

A fluorine resin tube having a length of 400 mm, an inner diameter of 29 mm and a thickness of 20 μm was formed by extrusion molding, using fluorine resin pellet C. The fixing belt of this example was prepared as in Example 1 except that this fluorine resin tube was employed. Table 1 also shows the results of evaluations of this fixing belt.

Example 5

Fluorine resin pellet D, which served as source material of the releasing layer, was prepared by the water-based emulsion polymerization method as disclosed in Japanese Patent Application Laid-Open No. 2004-161921, which was a technique of continuously feeding TFE, which was the principal component, and PEVE, which was a comonomer, and agitating the liquid mixture during the polymerization process. A fluorine resin tube having a length of 400 mm, an inner diameter of 29 mm and a thickness of 20 μm was formed by extrusion molding, using fluorine resin pellet D. Fluorine resin pellet D was made of a tetrafluoroethylene/perfluoroalkyl vinyl ether copolymer (PFA). As for its composition, $^{19}F$ nuclei were observed by nuclear magnetic resonance equipment to confirm that the copolymer contained perfluoroethyl vinyl ether (PEVE) by 5.8 mol % as perfluoroalkyl vinyl ether (PAVE).

A fluorine resin tube having a length of 400 mm, an inner diameter of 29 mm and a thickness of 20 μm was molded by extrusion molding, using fluorine resin pellet D. The fixing belt of this example was prepared as in Example 1 except that this fluorine resin tube was employed. Table 1 also shows the results of evaluations of this fixing belt.

Comparative Example 1

Fluorine resin pellet E, which served as source material of the releasing layer, was prepared by a method similar to the one used for providing fluorine resin pellet D in Example 5. Fluorine resin pellet E was made of a tetrafluoroethylene/perfluoroalkyl vinyl ether copolymer (PFA). As for its composition, $^{19}F$ nuclei were observed by nuclear magnetic resonance equipment to confirm that the copolymer contained perfluoroethyl vinyl ether (PEVE) by 1.4 mol % as perfluoroalkyl vinyl ether (PAVE) relative to tetrafluoroethylene (TFE).

A fluorine resin tube having a length of 400 mm, an inner diameter of 29 mm and a thickness of 20 μm was formed by extrusion molding, using fluorine resin pellet E.

The obtained fluorine resin tube was used as the surface layer of the fixing belt of this comparative example. As adhesive agent, an addition curable type silicone adhesive agent having no titanium oxide added thereto (SE1740: tradename, available from Dow Corning Toray Co., Ltd., prepared by mixing "Liquid A" and "Liquid B" by the same amount) was used. The fixing belt of this comparative example was prepared as in Example 1 except that the fluorine resin tube and the adhesive agent as described above were employed and the step of heating the fluorine resin tube to above the melting point after the covering operation using the fluorine resin tube was omitted. Table 1 also shows the results of evaluations of this fixing belt.

Comparative Example 2

A fluorine resin tube having a length of 400 mm, an inner diameter of 29 mm and a thickness of 20 μm was formed by extrusion molding, using fluorine resin pellet B. The prepared fluorine resin tube was used as the surface layer of the fixing belt of this comparative example. As adhesive agent, an addition curable type silicone adhesive agent having no titanium oxide added thereto (SE1740: tradename, available from Dow Corning Toray Co., Ltd., prepared by mixing "Liquid A" and "Liquid B" by the same amount) was used. The fixing belt of this comparative example was prepared as in Example 1 except that the fluorine resin tube and the adhesive agent as described above were employed and the step of heating the fluorine resin tube to above the melting point after the covering operation using the fluorine resin tube was omitted. Table 1 also shows the results of evaluations of this fixing belt.

Comparative Example 3

A fluorine resin tube having a length of 400 mm, an inner diameter of 29 mm and a thickness of 20 μm was formed by extrusion molding, using fluorine resin pellet B. The prepared fluorine resin tube was used as the surface layer of the fixing belt of this comparative example. As adhesive agent, an addition curable type silicone adhesive agent having no titanium oxide added thereto (SE1740: tradename, available from Dow Corning Toray Co., Ltd., prepared by mixing "Liquid A" and "Liquid B" by the same amount) was used. The fixing belt of this comparative example was prepared as in Example 1 except that the fluorine resin tube and the adhesive agent as described above were employed. Table 1 also shows the results of evaluations of this fixing belt.

Comparative Example 4

A fluorine resin tube having a length of 400 mm, an inner diameter of 29 mm and a thickness of 20 μm was formed by extrusion molding, using fluorine resin pellet A. The prepared fluorine resin tube was used as the surface layer of the fixing belt of this comparative example. As adhesive agent, an addition curable type silicone adhesive agent having no titanium oxide added thereto (SE1740: tradename, available from Dow Corning Toray Co., Ltd., prepared by mixing "Liquid A" and "Liquid B" by the same amount) was used. The fixing belt of this comparative example was prepared as in Example 1 except that the fluorine resin tube and the adhesive agent as described above were employed and the step of heating the fluorine resin tube to above the melting point after the covering operation using the fluorine resin tube was omitted. Fluorine resin pellet A was made of a tetrafluoroethylene/perfluoroalkyl vinyl ether copolymer (PFA). As for its composition, 19F nuclei were observed by nuclear magnetic resonance equipment to confirm that the copolymer contained perfluoroethyl vinyl ether (PEVE) by 4.2 mol % as perfluoroalkyl vinyl ether (PAVE).

Table 1 also shows the results of evaluations of this fixing belt.

Comparative Example 5

A fluorine resin tube having a length of 400 mm, an inner diameter of 29 mm and a thickness of 20 μm was formed by extrusion molding, using fluorine resin pellet A. The prepared fluorine resin tube was used as the surface layer of the fixing belt of this comparative example. As adhesive agent, an addition curable type silicone adhesive agent having no titanium oxide added thereto (SE1740: tradename, available from Dow Corning Toray Co., Ltd., prepared by mixing "Liquid A" and "Liquid B" by the same amount) was used. The fixing belt of this comparative example was prepared as in Example 1 except that the above-described fluorine resin tube was employed. Table 1 also shows the results of evaluations of this fixing belt.

Comparative Example 6

A fluorine resin tube having a length of 400 mm, an inner diameter of 29 mm and a thickness of 25 μm was formed by extrusion molding, using fluorine resin pellet A. The prepared fluorine resin tube was used as the surface layer of the fixing belt of this comparative example. As adhesive agent, an addition curable type silicone adhesive agent having no titanium oxide added thereto (SE1740: tradename, available from Dow Corning Toray Co., Ltd., prepared by mixing "Liquid A" and "Liquid B" by the same amount) was used. The fixing belt of this comparative example was prepared as in Example 1 except that the above-described fluorine resin tube was employed. Table 1 also shows the results of evaluations of this fixing belt.

<<Measurement of Polymerization Ratio of Perfluoroethyl Vinyl Ether (PEVE)>>

The polymerization ratio of perfluoroethyl vinyl ether (PEVE) can be measured by nuclear magnetic resonance equipment. The polymerization ratio of the perfluoroalkyl vinyl ether (PAVE) of each of the examples and the comparative examples was measured by nuclear magnetic resonance equipment (Model DSX400: tradename, available from Bruker Biospin GmbH). More specifically, $^{19}F$ nuclei were observed by NMR in a room temperature environment under conditions including a MAS frequency of 30 kHz and a cumulative number of 256. Then, the ratio of the integral value of the peaks attributable to tetrafluoroethylene (TFE) to the integral value of the peaks attributable to perfluoroethyl vinyl ether (PEVE) was determined from the obtained NMR chart and the polymerization ratio of PEVE was confirmed from the ratio. In Table 1, the value of the ratio is referred to as PEVE ratio.

<<Measurement of λ of Fluorine Resin Surface Layer, Computation of Thermal Resistance in Thickness Direction>>

The heat conductivity λ of the fluorine resin surface layer in the thickness direction is determined by the product of multiplication of the thermal diffusivity (in the thickness direction) α, the specific thermal capacity Cp and the density ρ ($\lambda=\alpha\times C_p\times\rho$). Note that the thermal diffusivity α, the specific thermal capacity Cp and the density ρ can be measured by known methods. In each of the examples and the comparative examples, the thermal diffusivity α was measured by Periodical Heating Method Thermal Diffusivity Measurement System (FTC-1: tradename, available from ADVANCE RIKO, Inc.) and the specific thermal capacity was measured by Differential Scanning calorimeter (DSC823e: tradename, available from Mettler-Toledo International Inc.), while the density ρ was measured by a dry automatic densitometer (AccuPyc 1330: tradename, available from Shimazu Corporation). In each of the measurements, the value obtained at 30° C. was adopted.

As for the thermal resistance in the thickness direction, the heat conductivity λ determined in a manner as described above and the formula of thickness t/heat conductivity λ were used to determine the thermal resistance.

<<Melt Unevenness Evaluation Test>>

An index of the followability of a fixing member relative to the unevenness of a sheet of paper can be obtained by observing the melt condition of toner after fixing a toner image formed on a sheet of paper.

10 unfixed toner images formed on respective sheets of paper that need to be evaluated for melt unevenness are successively fixed by a color laser printer equipped with a fixing belt (imageRUNNER-ADVANCE C5051: tradename, available from Canon Inc.) in an environment of temperature of 10° C. and relative humidity of 50% with an input voltage of 100 V. The sheets of paper to be used are A4-size sheets of recycled paper (Recycle Paper GF-R100: tradename, available from Canon Inc., thickness 92 μm, weight per unit area 66 g/m$^2$, waste paper compounding ratio 70%, Bekk smoothness 23 seconds (measurement by a method conforming to JIS P8119)). Each of the images to be evaluated for melt unevenness is a 10 mm×10 mm patch image formed with 100% density cyan toner and 100% density magenta toner and located at near the center of the sheet of paper.

The yardstick for melt unevenness is if toners of two colors melt and become mixed with each other or not when sufficiently high temperature and pressure are applied to the image formed by the toners of two colors. When only heat is applied but no pressure is applied, toner grain boundaries remain after fixation so that a condition where color toners are not mixed well occurs and hence melt unevenness arises. When a fixing member cannot sufficiently follow unevenness, while color mixing occurs at protruding areas but only insufficient color mixing occurs at recessed areas. Therefore, in the melt unevenness test, the followability to unevenness was judged by observing the melt condition in the region where the image is formed.

After successively printing 10 images to be evaluated for melt unevenness on respective sheets of paper, the tenth sample was drawn out and the image part on the sheet of paper was observed through an optical microscope to evaluate the melt unevenness. The evaluation criteria are as follows (see "melt unevenness" in Table 1).

<Evaluation Ranks> rank A: state where substantially no toner grain boundaries are observable even in recessed areas of paper tissues and color toners are well mixed both in protruding areas and recessed areas rank B: state where toner grain boundaries are partly observable in recessed areas of paper tissues but color toners are by and large well mixed both in protruding areas and recessed areas rank C: state where color toners are well mixed only in protruding areas of paper tissues and many toner grain boundaries are observable in recessed areas <<Fixability Evaluation Test>>

A rubbing test is a method for evaluating how firmly toners have been fixed with respect to paper and provides an index of the level of heat supplying capacity from the fixing member to toners. There is a tendency that the fixability is raised as the thermal resistance in the thickness direction is reduced.

50 sheets of papers carrying respective images to be tested for the fixability are successively subjected to a fixing process by a color laser printer equipped with a fixing belt as defined above in an environment having a temperature of 10° C. and a relative humidity of 50% with an input voltage of 100 V. The sheets of paper are similar to the ones used for the melt unevenness evaluation test. Each of the images to be evaluated for the fixability includes nine 5 mm×5 mm patch monochromatic black toner images that are formed by using halftone checker flag patterns of 2×2 dots and arranged at nine positions on the sheet of paper that carries the image.

After successively printing 50 images to be evaluated for the fixability, a predetermined number of sheets of paper (1st, 10th, 20th and 50th) are drawn out from the 50 sheets as so many samples. A weight having a predetermined weight (200 g) is placed on the image forming surface side of each of the sample sheets via lens-cleaning paper (Dusper K-3: tradename, available from OZU CORPORATION). Then, the weight placed on the lens-cleaning paper is forcibly driven to slide on and rub the image forming surface so as to reciprocate 5 times. The reflection density of the image is measured before and after the sliding and rubbing motion of the weight. A densitometer (RD918: tradename, available from GretagMacbeth) was used to measure the reflection density.

The density reduction rate is determined by using the formula of (density before sliding and rubbing−density after sliding and rubbing)/density before sliding and rubbing×100 (%).

The density reduction rate for the best fixability that is observed when the image to be evaluated is not deteriorated and no image part is missing at all after the evaluation test is equal to 0%. Contrarily, the density reduction rate for the worst fixability that is observed when the image to be evaluated is totally missing after the evaluation test is equal to 100%. The greater the value of the density reduction rate, the poorer the fixability.

The numerical yardstick for the toner fixability is as follows. When the density reduction rate is 30% or more in an environment having a temperature of 10° C. and a relative humidity of 50%, the toner image may become partly missing in an ordinary operating environment. When the density reduction rate is 20% or more and less than 30% in an environment having a temperature of 10° C. and a relative humidity of 50% as described above, no problem arises in an ordinary operating environment but the toner image can become partly missing as the image carrying surface is strongly folded. When the density reduction rate is 10% or more and less than 20% in an environment having a temperature of 10° C. and a relative humidity of 50% as described above, no problem arises in an ordinary operating environment but a density reduction can take place as the image carrying surface is strongly rubbed. When the density reduction rate is less than 10% in an environment having a temperature of 10° C. and a relative humidity of 50% as described above, no problem such as density reduction arises in an ordinary operating environment.

In view of the above-described yardstick, the density reduction rates of the nine images on each sheet of paper were determined and the worst value of the density reduction rates was used to judge the toner fixability by referring to the evaluation criteria that are listed below.

The evaluation ranks given respectively to the examples and the comparative examples are listed under the heading of "fixability" in Table 1.

<Evaluation Ranks> rank A: density reduction rate less than 10% rank B: density reduction rate 10% or more and less than 20% rank C: density reduction rate 20% or more and less than 30% rank D: density reduction rate 30% or more

<<On Peel Adhesion Strength Between Silicone Rubber Elastic Layer and Fluorine Resin Surface Layer and Peel Evaluation Test>>

The peel adhesion strength between the silicone rubber elastic layer and the fluorine resin surface layer of the fixing member at 25° C. is 3.0 N/cm or more and 20.0 N/cm or less. Then, the elastic layer undergoes a cohesive failure (no peel appears at the interface of the adhesive layer and the elastic layer and at the interface of the adhesive layer and the substrate) in a peel test of measuring the peel adhesion strength between the surface layer and the elastic layer. A sufficient adhesion strength is secured when such a fixing member is installed in a fixing apparatus and operated for actual use in a pressurized condition. The silicone rubber elastic layer and the fluorine resin surface layer are excellently bonded to each other and no peel takes place at the interface thereof but the silicone rubber elastic layer undergoes a cohesive failure when the peel adhesion strength is 3.0 N/cm or more. Therefore, the peel adhesion strength is dependent rather on the rupture strength of the silicone rubber elastic layer than on the pure adhesiveness within the range of 3.0 N/cm or more. On the other hand, the cross-linking density of the adhesive layer and the silicone rubber elastic layer becomes too high and the flexibility of the fixing member is damaged within the range of more than 20.0 N/cm. Therefore, the peel adhesion strength is to be 20.0 N/cm or less.

As described above, titanium oxide can be added to the adhesive layer in order to control the peel adhesion strength and confine the strength within the above range. Alternatively, the peel adhesion strength can be controlled by causing the adhesive agent to permeate into the silicone rubber elastic layer to an appropriate extent and suppress any excessive rise of the hardness of the elastic layer by irradiating the silicone rubber elastic layer with UV rays as disclosed, for example, in Japanese Patent Application Laid-Open No. 2009-244887.

The adhesion strength between the silicone rubber elastic layer and the fluorine resin surface layer is measured according to "Adhesives-Determination of peel strength of bonded assemblies—Part 1:90° peel" (JIS K6854-1:1999) defined in the Japanese Industrial Standards. In the test, a sample which was placed under "Standard Atmosphere" defined in the Japanese Industrial Standard (JIS K7100:1999), i.e. air temperature of 23° C., Relative humidity of 50%), was employed, and the test was conducted under the "Standard Atmosphere".

Figure 5:
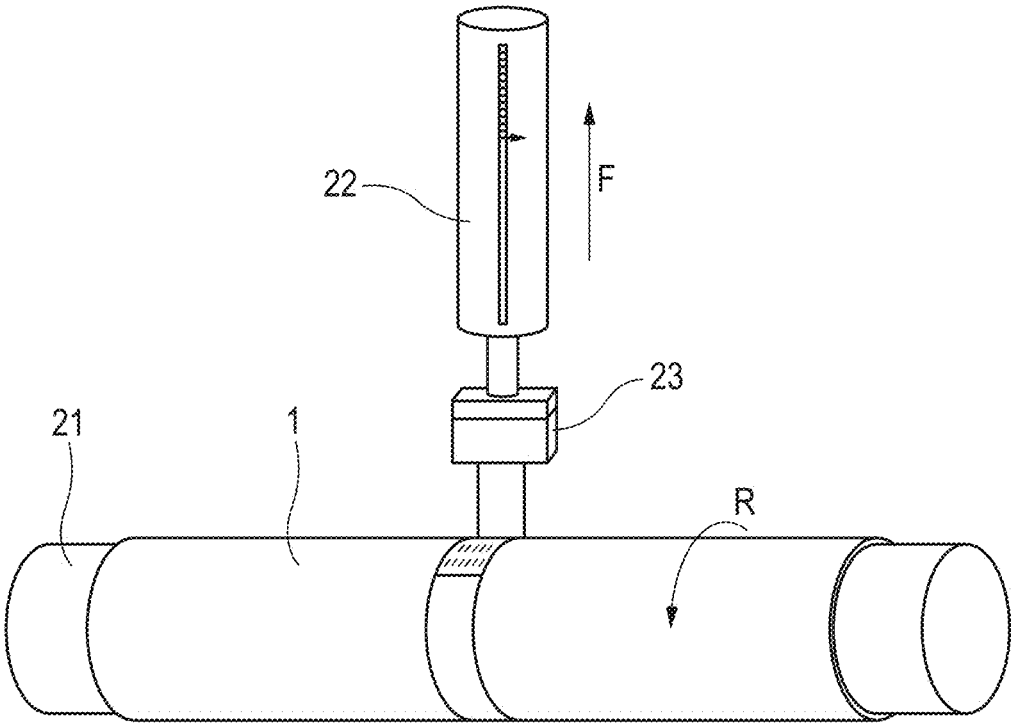
FIG. 5 is a schematic illustration of a method of measuring the peel adhesion strength.

The method of measuring the adhesion strength will specifically be described below by referring to FIG. 5. If necessary, a core 21 is inserted into the fixing member 1 (the belt-shaped fixing member in FIG. 5, fixing belt) so that the substrate of the fixing member 1 may not be deformed. Then, the fixing member is cut in the circumferential direction by a razor from the surface layer side at two positions separated from each other by 1 cm to produce two slits that run in parallel with each other and get to the surface of the silicone rubber elastic layer. Thereafter, the fixing member is cut in the longitudinal direction of the fixing member at a position of the slits running in parallel with each other and extending in the circumferential direction so as to make the cut reach the parallel slits. Then, the cut part is forcibly peeled in the circumferential direction by about 2 cm by a razor from the interface of the fluorine resin surface layer and the silicone rubber elastic layer and the front end of the peeled part is pinched by chuck section 23 of force gage 22. If the surface layer is thin and plastic deformation may take place, a reinforcement polyimide belt may be bonded to the surface of the surface layer and the slits may be formed from the polyimide belt. With this arrangement, any possible plastic deformation of the surface layer can be suppressed.

Then, the core 21 (or the substrate) is firmly secured in a manner that the fixing member remains freely rotatable in the circumferential direction and the force gage 22 is pulled up by an appropriate means (not shown). More specifically, the force gage is pulled vertically up in the direction perpendicular to the tangential direction of the fixing member main body at the base position of the peeled end at a rate of 50 mm/min until the length of the layer at the peeled surface layer side becomes equal to 50 mm. This length is also referred to as "peel length".

At this time, the peeling direction F needs to be held constantly equal to 90° relative to the tangential direction of the fixing member main body at the base position of the peeled end. To keep this angle of 90°, firstly, when the peeled end is pinched by the force gage, the peeled end needs to be pinched such that the peeled layer at the side of the silicone rubber elastic layer shows the angle of 90°. Then, secondly, the force gage is pulled up from right above the axis of rotation of the core 21 in the vertical direction F at the rate of 50 mm/min and, at the same time, the core 21 is driven to rotate in the direction of R in FIG. 5 such that the moving speed of the core 21 at tangential line is equal to the moving speed in the vertical direction F. More specifically, if the outer diameter of the fixing belt is 30 mm, for instance, the peeling direction can be held to be equal to 90° relative to the tangential direction of the fixing member main body by making the rotational speed of the core equal to 0.53 rpm. As a result of the measuring operation described above, a curve showing the relationship between the applied force and the distance moved by the grasp and move operation across a peel length of 50 mm is obtained. Then, the arithmetic mean value of the peel adhesion strength is determined from the applied force-distance moved by the grasp and move operation curve. The obtained value is defined as "the peel adhesion strength" at the single spot of measurement. Note that the force for every 0.1 mm of the distance moved by the grasp and move operation was used to determine the arithmetic means value of peel adhesion strengths.

Note that the peel adhesion strength in each of the examples and the comparative examples was determined by conducting a peel test between the surface layer and the elastic layer as described above at arbitrarily selected five spots that do not allow any interference of the results of measurement to take place. Then, the arithmetic mean value of "the peel adhesion strengths" determined from the results of measurement at the above-described five spots was defined as "the peel adhesion strength between the surface layer and the elastic layer" in each of the examples and the comparative examples. In the instance where the fixing member is such that the peeled length could not be made to be equal to 50 mm in the peel test at a measurement spot, the peel tests at the plurality spots were conducted so as to make the total peel length equal to 250 mm. Then, the applied force-distance moved by the grasp and move operation curve was drawn and the arithmetic mean value of peel adhesion strengths was determined from the applied force-distance moved by the grasp and move operation curve. The obtained value was defined as "the peel adhesion strength between the surface layer and the elastic layer" of the fixing member. Table 1 shows the peel adhesion strength of each of the examples and the comparative examples obtained as a result of the evaluation test under the heading of "peel test•-peel adhesion strength".

The fracture surface formed in each of the peel tests was observed to judge if the elastic layer had undergone a cohesive failure or not in the peel test between the surface layer and the elastic layer, according to the specifications defined in "Adhesives—Designation of main failure patterns" (JIS K6866: 1999). More specifically, in an instance where the destroyed silicone rubber elastic layer was adhering to both the substrate side and the fluorine rein surface side, the silicone rubber elastic layer was judged to undergo a cohesive failure. A state where the fracture surface showed a mixture fracture of cohesive failure and adhesive failure, the silicone rubber elastic layer was judged as cohesive failure when the cohesive failure part of the silicone rubber elastic layer is 50% or more of the peeled surface area and judged as adhesive failure when the cohesive failure part is less than 50%.

Note that, in Table 1, λ represents the heat conductivity in the thickness direction and, as for the value of the thermal resistance (in the thickness direction), for example, the expression of "1.05E-04" is the same as "$1.05\times10^{-4}$".

TABLE 1

| | Surface layer | | | | | | Evaluation test | | | |
|---|---|---|---|---|---|---|---|---|---|---|
| | Pellet | PEVE ratio (mol %) | λ (W/m · K) | Thickness (μm) | Thermal resistance ($m^2 \cdot K/W$) | Adhesive layer prescription | Melt unevenness | Fixability | Peel test Peel adhesion strength (N/cm) | Peel test Fracture surface |
| Example 1 | A | 4.2 | 0.19 | 20 | 1.05E−04 | Titanium oxide compounded | A | A | 5.6 | Cohesive failure |
| Example 2 | A | 4.2 | 0.19 | 6 | 3.16E−05 | Titanium oxide compounded | A | A | 5.5 | Cohesive failure |
| Example 3 | A | 4.2 | 0.18 | 23 | 1.28E−04 | Titanium oxide compounded | A | A | 5.4 | Cohesive failure |
| Example 4 | C | 3.0 | 0.19 | 20 | 1.05E−04 | Titanium oxide compounded | A | A | 5.5 | Cohesive failure |
| Example 5 | D | 5.8 | 0.19 | 20 | 1.05E−04 | Titanium oxide compounded | A | A | 5.5 | Cohesive failure |
| Comp Ex 1 | E | 1.4 | 0.11 | 20 | 1.82E−04 | — | C | C | 5.4 | Cohesive failure |
| Comp Ex 2 | B | 2.8 | 0.11 | 20 | 1.82E−04 | — | B | B | 5.5 | Cohesive failure |
| Comp Ex 3 | B | 2.8 | 0.18 | 20 | 1.11E−04 | — | B | A | 2.3 | Cohesive failure |
| Comp Ex 4 | A | 4.2 | 0.11 | 20 | 1.82E−04 | — | A | B | 4.9 | Cohesive failure |
| Comp Ex 5 | A | 4.2 | 0.18 | 20 | 1.11E−04 | — | A | A | 1.0 | Interfacial Peeling |
| Comp Ex 6 | A | 4.2 | 0.18 | 25 | 1.39E−04 | — | B | B | 2.4 | Cohesive failure |

As seen from Table 1, in each of Examples 1 through 5, a fixing belt that satisfied the requirement of rank A for both melt unevenness and fixability and also the requirement of between 3.0 and 20.0 N/cm for peel adhesion strength was obtained. In each of Comparative Examples 1 through 6, rank B or lower was given to the fixing belt for at least one of melt unevenness and fixability, and/or the peel adhesion strength of the fixing belt was out of the range between 3.0 and 20.0 N/cm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-148635, filed Jul. 28, 2016, which is hereby incorporated by reference herein in its entirety.

What is claimed is:

1. A fixing member comprising:

a substrate;

an elastic layer on the substrate; and a surface layer bonded to the elastic layer with an adhesive layer, the surface layer containing a fluorine resin, wherein:

the surface layer has a thermal resistance in a thickness direction of $3.0\times10^{-5}$ $m^2 \cdot K/W$ to $1.3\times10^{-4}$ $m^2 \cdot K/W$;

a peel adhesion strength between the surface layer and the elastic layer is 3.0 N/cm to 20.0 N/cm;

the elastic layer undergoes a cohesive failure in a peel test between the surface layer and the elastic layer;

the fluorine resin contains a tetrafluoroethylene/perfluoroethyl vinyl ether copolymer; and a polymerization ratio of perfluoroethyl vinyl ether in the tetrafluoroethylene/perfluoroethyl vinyl ether copolymer is 3.0 mol % to 5.8 mol %.

2. The fixing member according to claim 1, wherein the adhesive layer contains a cured product of an addition curable type silicone rubber adhesive.

3. The fixing member according to claim 1, wherein the adhesive layer contains titanium oxide.

4. The fixing member according to claim 1, wherein the substrate has a shape of an endless belt, and wherein the elastic layer, the adhesive layer, and the surface layer are laminated on an outer circumferential surface of the substrate in this order.

5. The fixing member according to claim 1, wherein a thickness of the surface layer is 6 μm to 23 μm.

6. The fixing member according to claim 1, wherein a thickness of the substrate is 20 μm to 100 μm.

7. The fixing member according to claim 1, wherein a thickness of the adhesive layer is 10 μm or less.

8. A fixing apparatus comprising:

a fixing member; and a heating device of the fixing member, wherein:

the fixing member comprises:

a substrate, an elastic layer on the substrate, and a surface layer bonded to the elastic layer with an adhesive layer, the surface layer containing a fluorine resin;

the surface layer has a thermal resistance in a thickness direction of $3.0\times10^{-5}$ $m^2 \cdot K/W$ to $1.3\times10^{-4}$ $m^2 \cdot K/W$;

a peel adhesion strength between the surface layer and the elastic layer is 3.0 N/cm to 20.0 N/cm;

the elastic layer undergoes a cohesive failure in a peel test between the surface layer and the elastic layer;

the fluorine resin contains a tetrafluoroethylene/perfluoroethyl vinyl ether copolymer; and a polymerization ratio of perfluoroethyl vinyl ether in the tetrafluoroethylene/perfluoroethyl vinyl ether copolymer is 3.0 mol % to 5.8 mol %.

9. An electrophotographic image forming apparatus comprising a fixing apparatus, wherein the fixing apparatus comprises:

a fixing member, and a heating device of the fixing member, wherein the fixing member comprises:

a substrate, an elastic layer on the substrate, and a surface layer bonded to the elastic layer with an adhesive layer, the surface layer containing a fluorine resin, wherein:

the surface layer has a thermal resistance in a thickness direction of $3.0\times10^{-5}$ $m^2\cdot K/W$ to $1.3\times10^{-4}$ $m^2\cdot K/W$;

a peel adhesion strength between the surface layer and the elastic layer is 3.0 N/cm to 20.0 N/cm;

the elastic layer undergoes a cohesive failure in a peel test between the surface layer and the elastic layer;

the fluorine resin contains a tetrafluoroethylene/perfluoroethyl vinyl ether copolymer; and a polymerization ratio of perfluoroethyl vinyl ether in the tetrafluoroethylene/perfluoroethyl vinyl ether copolymer is 3.0 mol % to 5.8 mol %.

10. A method of manufacturing a fixing member comprising:

(1) providing a fluorine resin tube containing a fluorine resin, the fluorine resin tube being a cylindrical extrusion-molded fluorine resin product;

(2) bonding the fluorine resin tube to a surface of an elastic layer on a substrate with an addition curable type silicone rubber adhesive layer; and (3) heating the fluorine resin tube bonded onto the elastic layer to not lower than a melting point of the fluorine resin contained in the fluorine resin tube, wherein:

the fluorine resin contains a tetrafluoroethylene/perfluoroethyl vinyl ether copolymer;

a polymerization ratio of perfluoroethyl vinyl ether in the tetrafluoroethylene/perfluoroethyl vinyl ether copolymer is 3.0 mol % to 5.8 mol %; and the addition curable type silicone rubber adhesive layer contains titanium oxide.

* * * * *